US005661278A

United States Patent [19]

Atkinson et al.

[11] Patent Number: 5,661,278

[45] Date of Patent: Aug. 26, 1997

[54] PRESSURE RESPONSIVE APPARATUS COUPLES BY A SPRING-LOADED LINEARLY MOVING CARRIER TO OPERATE A SWITCH UNIT

[75] Inventors: Louis D. Atkinson, New Berlin; Kevin M. Rave, West Allis, both of Wis.

[73] Assignee: Airtrol Components Inc., New Berlin, Wis.

[21] Appl. No.: 543,016

[22] Filed: Oct. 13, 1995

[51] Int. Cl.[6] ..... H01H 35/34

[52] U.S. Cl. ..... 200/83 J; 73/717; 200/302.1; 200/83 A

[58] Field of Search ..... 337/317–320; 200/83 S, 83 R, 83 J, 83 P, 83 A, 83 Y, 302.1, 81 R; 73/715–717, 723; 307/118; 340/626

[56] References Cited

U.S. PATENT DOCUMENTS

| | | | |
|---|---|---|---|
| 3,890,477 | 6/1975 | Saunders | 200/83 P |
| 4,166,996 | 9/1979 | Matthies | 337/386 |
| 4,274,752 | 6/1981 | Huber | 400/477 |
| 4,698,612 | 10/1987 | Koehler | 337/320 |
| 4,900,883 | 2/1990 | Brame | 200/83 S |
| 5,001,317 | 3/1991 | Atkinson et al. . | |
| 5,061,832 | 10/1991 | Squires | 200/83 J |
| 5,471,022 | 11/1995 | Kiss | 200/83 B |

*Primary Examiner*—Gerald P. Tolin

*Attorney, Agent, or Firm*—Andrus, Sceales, Starke & Sawall

[57] ABSTRACT

A miniature pneumatic switch apparatus has a diameter of three-eights inches and a height of five sixteenths inches and operates from minimal pressure to 100 psi. A pressure responsive unit includes outer spaced guide walls extending from a pressure movable wall. A switch unit is secured to the guide walls in spaced aligned relation to the movable wall and forms an operating chamber. A spring carrier is mounted within the chamber. The carrier includes a plate having a lateral opening with a beam spring extending therethrough, with the spring ends supported in openings aligned with the plate. An elastic band encircles the support walls and holds the beam spring in place. The opening in the plate facing the switch unit is a flat face, and the opposite face facing the movable wall is curved for line contact with the spring.

17 Claims, 2 Drawing Sheets

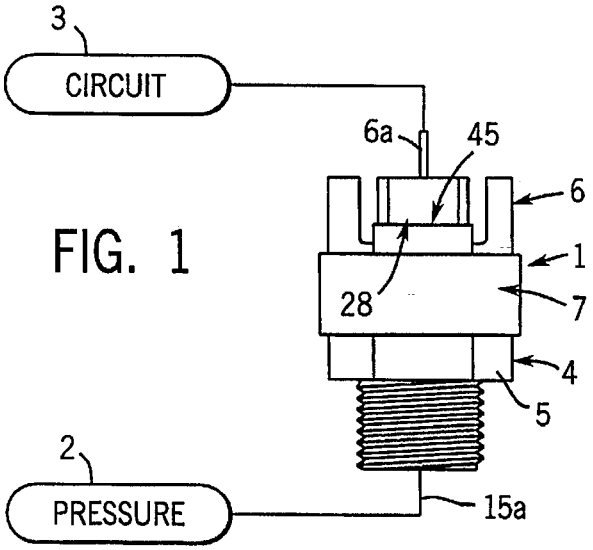
FIG. 1
FIG. 2
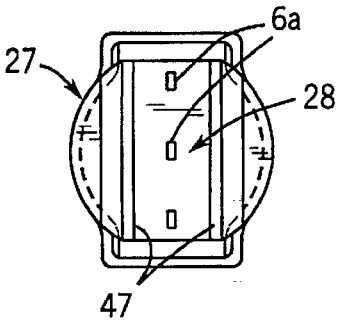
FIG. 3
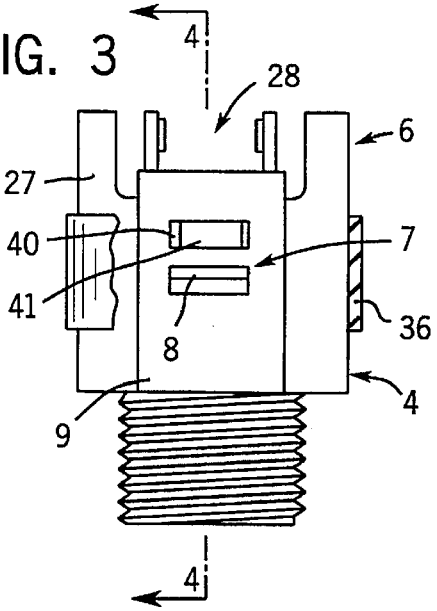
FIG. 4
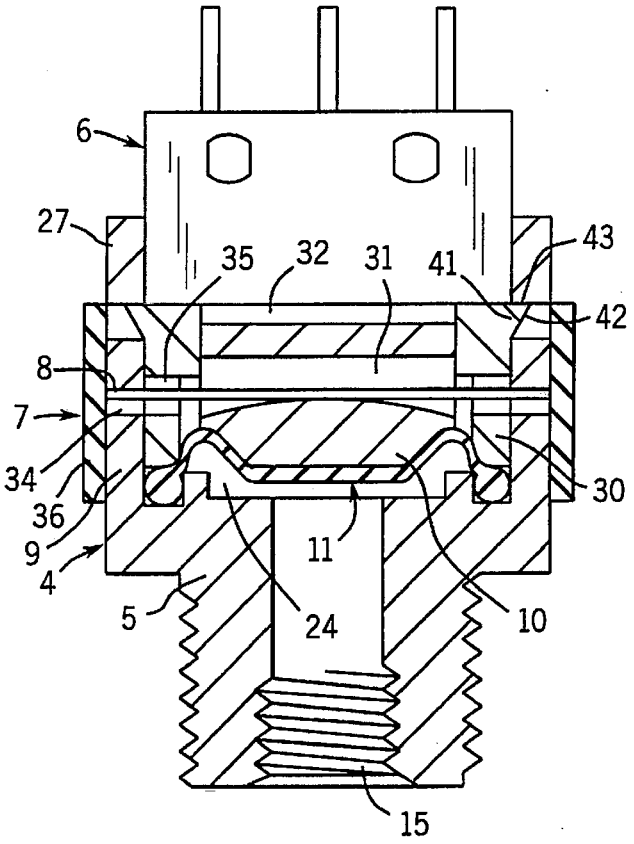
FIG. 10
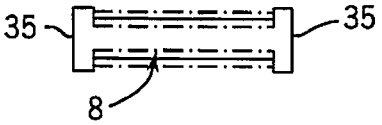

FIG. 5
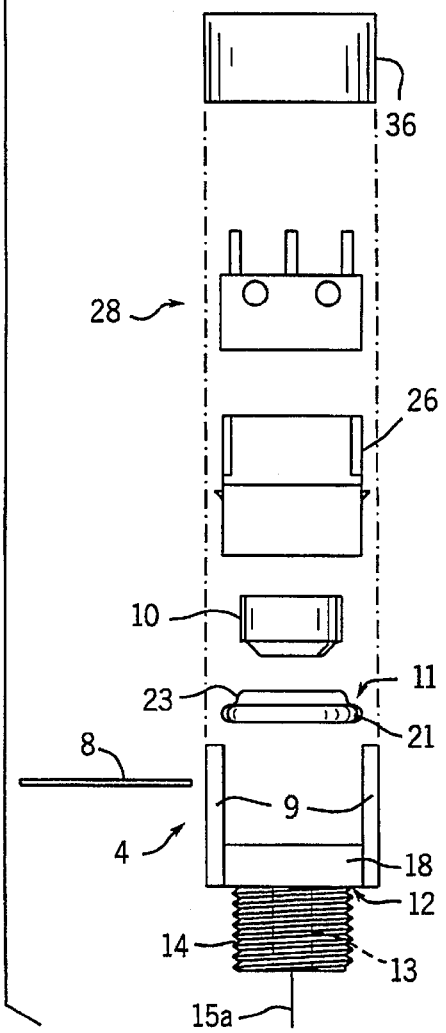
FIG. 6
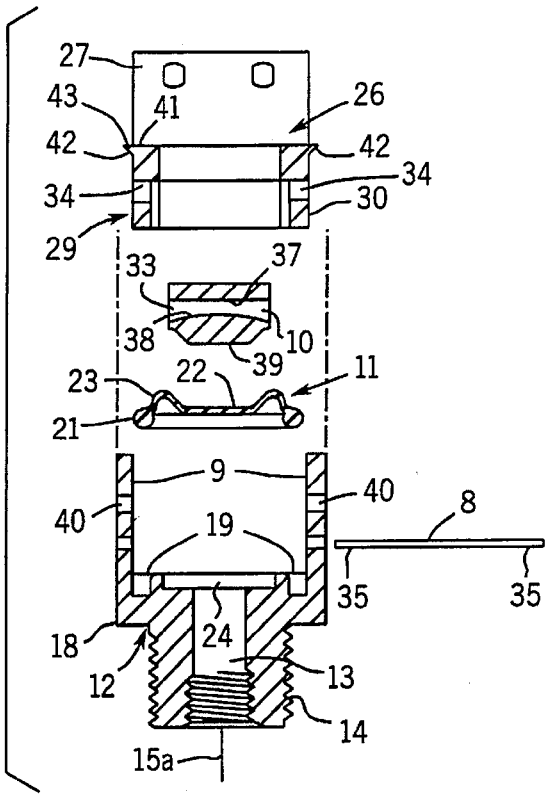
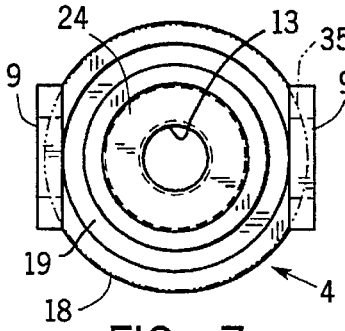
FIG. 7
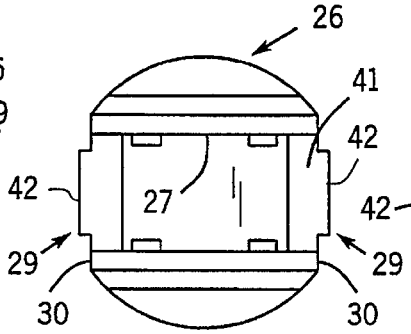
FIG. 8
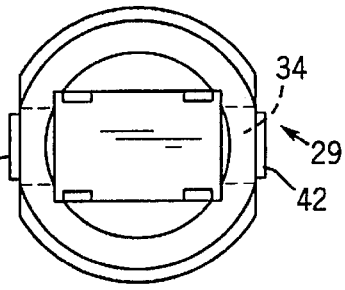
FIG. 9

PRESSURE RESPONSIVE APPARATUS COUPLES BY A SPRING-LOADED LINEARLY MOVING CARRIER TO OPERATE A SWITCH UNIT

BACKGROUND OF THE INVENTION

This invention relates to a fluid pressure responsive electric switch apparatus, and particularly a "pneumatic" electric switch unit, which is adapted to sub-miniature construction.

Pressure responsive switches are widely used in various industrial as well as consumer product applications. Generally, in the prior art, a movable wall, such as flexible diaphragm unit, is incorporated in a pressure chamber unit coupled to actuate a switch mechanism secured to switch chamber. For example, U.S. Pat. No. 5,001,317 which issued on Mar. 19, 1991 to Louis D. Atkinson et al and is assigned to a common assignee with this application, discloses a highly versatile and practical pneumatic switch structure. As more fully disclosed therein, the switch structure includes a switch chamber within which a snap action switch unit is mounted. An actuator projects through the snap action switch unit and is coupled directly thereto for moving the switch with respect to the opposite ends of the switch housing. At least one end includes a diaphragm enclosure defining a pressure chamber. The opposite end is provided with a similar diaphragm pressure chamber to produce a deferential switch, with a spring loaded reset or manual reset. Although such a switch structure provides a highly satisfactory functional responsive, its application has been primarily directed to installations which permit a pneumatic-to-electric switch structure of a significant physical size construction.

The development of miniaturized and compact circuit systems has created a continuous demand for ever smaller pressure responsive switches, and particularly pneumatically operated electric switches. Thus, certain applications often include size specifications for a pneumatic-to-electric switch having a maximum width of about one-half inch and a maximum length of about one inch. Further, the switch structure should provide for adjustment of the pressure set point and/or also permit factory setting of the set point. The small pressure responsive switches should preferably operate for either or both positive pressures and vacuum pressures ranges. Thus, in a typical application which has been considered, the switch structure must operate under a three ampere load and operate with a working positive pressure range of zero to 100 PSI (pounds per square inch) and a vacuum pressure range of zero to 30 inches (Hg) (of mercury). The device often must be chemically resistant and operate with a stable functioning at temperatures of 250° F. The structure must be as small as possible physically while being repairable and highly cost effective both in original manufacture and maintenance.

SUMMARY OF THE PRESENT INVENTION

Generally, in accordance with the present invention, the switch apparatus includes a pressure responsive unit or sensor including a pressure chamber to be connected to a pressure supply. The chamber includes a movable member is positioned in accordance with the sensed pressure. A switch unit is located in spaced relation to the movable member and connected by a support structure, with a special spring loaded actuator mounted therebetween. The spring loaded actuator generally includes a carrier in the form of a body member having an opening. A beam spring in the opening is mounted to the support structure and supports the carrier for engagement with the movable member for selective operative engagement with the switch unit. The beam spring is preferably removably mounted to permit changing the pressure response characteristic of sensor by changing of the spring characteristic.

In a preferred construction, the actuator carrier is a plate having a pass-through opening. The switch unit and the pressure responsive sensor are joined by a guide wall structure therebetween. The plate is slidably mounted within the opening and chamber defined between the guide walls. The guide wall structure has an opening aligned with the actuator opening. A flat beam spring passes through the aligned openings and is supported on the guide walls to support the spring and thereby the plate. An encircling elastic band, or other securement system, holds the beam spring within the openings to allow ready assembly of the apparatus as well as permitting spring replacement for controlling of the pressure response characteristic switch apparatus.

More particularly, in accordance with the preferred practical construction of the present invention, a pressure sensor is formed with a base member having an outwardly opening pressure chamber, with guide walls projecting outwardly from opposite sides thereof. A diaphragm unit is located to close pressure sensing chamber. A switch support unit includes an outer body for receiving a switch and side walls projecting therefrom in telescoped abutting engagement with the guide walls of the base member. The inner end of the switch side walls engages the peripheral portion of the diaphragm to the base to close the pressure chamber. The sidewalls have interlocking means to interconnect the two body members into a stable structure, with a plate disposed within the chamber formed thereby. The side walls include aligned openings to receive the ends of a beam spring which passes through a central opening in the plate. An elastic band encloses the sidewalls to seal the chamber and hold the flat beam spring in location within the plate. The configuration and construction of the beam spring member determines the spring characteristic of the unit, and thus provides a ready means for varying the pressure range response characteristic and the like of the small miniature pressure responsive switch unit. Thus, a plurality of similarly sized beam spring may be provided having end members adapted to mate with the alignment openings. The central portion of the beam spring between the ends may be varied in width or thickness to vary the beam characteristic in a precise predesigned manner. A pressure responsive switch apparatus having a height of approximately 0.8 inches and a diameter of approximately 0.6 inches can be readily constructed with the structure disclosed herein.

The inventor has found that the present invention can be readily constructed using present day technology for providing a miniature switch apparatus. The body members may all be appropriately molded plastic members with a snap together connection and with a molded diaphragm and the like. The present invention thus provides a very cost effective structure and method of forming a miniature pressure responsive switch unit, which is readily adapted to wide variations and specifications, using present day technology.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment. In the drawings:

FIG. 1 is an elevational view of a pressure responsive switch apparatus connected in a diagrammatically disclosed control circuit;

FIG. 2 is a top elevational view of the switch control unit shown in FIG. 1;

FIG. 3 is an enlarged side elevational view of the switch apparatus shown in FIG. 1 with parts broken away and a switch unit removed;

FIG. 4 is a vertical section taken generally on line 4—4 of FIG. 3;

FIG. 5 is an exploded view of the switch apparatus shown in FIGS. 1 and 3;

FIG. 6 is an exploded view of components shown in FIG. 5 with the components shown in cross-section;

FIG. 7 is a top view of the base of a pressure responsive unit shown in FIGS. 1–6;

FIG. 8 is a top view of a switch support apparatus shown in FIGS. 1–7;

FIG. 9 is a bottom view of the switch support structure; and

FIG. 10 is an elevational view of a beam spring, with variations in the spring structure shown in phantom.

DESCRIPTION OF THE ILLUSTRATED EMBODIMENT

Referring to the drawings and particularly to FIGS. 1 and 4, an elevational view of a miniature compact switch assembly 1 connected to a pressure source 2 and an electrical circuit 3 is illustrated. The assembly 1, which is a preferred embodiment of the invention, includes a base structure 4 having a pressure responsive unit 5 connected at one end to the source 2. A switch unit 6 is mounted to the outer or opposite end of the base structure in alignment with the unit 5 and in spaced relation thereto. Suitable electric terminals 6*a* provide interconnection to the circuit 3. A pressure responsive switch actuating system 7 is located and enclosed between the interface of the switch unit 6 and the pressure responsive unit 5. As shown in FIGS. 3–6, actuating system 7 includes a beam spring 8 which is releasably secured to the outer walls 9 of the base structure 4. An actuator 10 is mounted on the beam spring 8 and located adjacent a pressure response diaphragm unit 11 of pressure responsive unit 5. The spring characteristic of the beam spring 8 determines the pressure range of the miniature switch assembly. The range of the switch assembly is readily set by selection of the beam spring 8. The total assembly is readily constructed as a miniature pressure responsive switch unit having a smaller size than prior art devices, while operating in required ranges of pressure.

As more clearly shown in FIGS. 3–6, a preferred embodiment of the switch apparatus or assembly is more fully illustrated.

Referring particularly to FIGS. 3–6, the pressure responsive unit 5 includes a sensor housing 12 integral to the base structure. The housing 12 includes an inlet port 13 having an external thread 14 for mounting of the switch assembly 1 to a suitable support. The port 13 has an internal thread 15 for connection to a suitable pressure line 15*a* and thereby source 2, as shown in FIG. 1. The sensor housing 12 has a base 18 shown as a circular wall. Walls 9 extend as flat guide walls from the opposite side of the base 18 and project, outwardly therefrom. An annular groove 19 is formed in the outer face of the base 18 immediately inwardly of the guide walls 9. The diaphragm unit 11 is shown as a molded diaphragm having an annular mounting and outer ring 21 complementing the annular groove 19. The ring 21 is disposed within the groove 19 and includes an outwardly spaced diaphragm wall 22 connected to the mounting ring 21 by a convoluted connection 23. The diaphragm unit 11 as sealed within the groove 19 defines a movable wall of a pressure chamber 24, (shown in FIG. 4); with the outer diaphragm wall 22 moving generally in an axial direction as a result of the convoluted connection in response to changes in Pressure within the chamber 24.

In the illustrated embodiment, switch unit 6 includes a tubular support 26, and having a generally circular outer support wall 27 for releasably supporting a switch 28, and a generally circular inner wall 29 of a smaller diameter projecting therefrom. The inner wall 29 has truncated flat wall portions 30 and is telescoped between the flat guide walls 9 with walls portions 30 firmly engaging the latter. Switch 28 is mounted within support wall 27 with a switch operator 31 extending into the circular wall 29. The inner end of the circular inner wall 29 is located in clamping engagement with the annular ring 21 of the diaphragm unit 11 to seal the ring within the groove 19 and establish a fluid tight pressure chamber 24. The truncated circular wall 29 within walls 9 also forms a switch actuator chamber 32 between the switch support 26 and the pressure responsive unit and particularly diaphragm wall 22.

Switch actuator 10 is mounted within the chamber 32 and is located for movement by the diaphragm unit 11 into operative engagement with the switch operator 31.

Referring particularly to FIGS. 4–6, the switch actuator 10 is a floating plate having a central opening 33 extending across the chamber 32 between the flat side wall portions 30 of support 26. Beam spring 8 is a flat, metal member which passes freely through the opening 33. The telescoped side walls 9 of the pressure responsive unit include openings 34 aligned with openings 34' in the walls 30 of switch support 26. The openings 34 and 34' are rectangular openings, with the openings 34 in the outer guide walls of a lesser depth than the openings 34' in the telescoped walls 30. The opposite ends 35 of the spring 8 are located in the support openings 34 and axially support the ends of spring 8. The spring 8 is held in position within support openings 35 by an encircling elastic band 36, encircling the support structure and chamber 32.

The outer-face 37 of the actuator plate 10, located toward the switch unit, is a flat face. The opposite face 38, located toward the diaphragm wall 22, is curved across the length of the opening to define an essentially line contact with the center of the spring 8. The outer surface 39 of the actuator plate 10 is shaped to conform to the dish-shape of the diaphragm wall 22 and provide corresponding complementing interengagement between the diaphragm wall 22 and the actuator plate 10.

The pressure in pressure chamber 24 expands the diaphragm 11 with diaphragm wall 22 moving the plate 10 and spring 8 outwardly toward switch 28. The ends 35 of spring 8 engage the end wall of openings 34 and resiliently support the actuator against further movement. As the pressure increases, the diaphragm 22 expands and deflects the alignment portion of spring 8, moving the outer wall of plate 10 into operative engagement with the switch operator 31. At a pressure determined by the spring characteristic of spring 8, the operator 31 is moved to actuate the switch 28.

The opening 33 in plate 10 and the spring support openings 34 are shown with a depth greater than the thickness of spring 8. The pressure range of the switch assembly 1 is set by selection of the spring 8. The spring characteristic may be changed by varying the thickness as well as the shape, material or other construction of the spring. The enlarged openings accommodate a reasonable wide range of thickness while also permitting rapid and reliable assembly. The elastic band 36 provides a reliable support of the spring as well as producing a tight enclosure of the actuator chamber 32.

A convenient array of different springs may be readily provided by varying the width, thickness or shape of the spring 8.

In the illustrated embodiments of FIG. 10, spring 8 is shown with rectangular ends substantially corresponding to the perimeter of the support openings 34. The width of the spring between such ends is selected to produce a predetermined spring characteristic, as shown in full line for one spring characteristic with and phantom lines illustration showing different widths for different charactistics in FIG. 10. A composite spring of the same or different materials may also provide a series of different spring characteristics. Any other spring construct can, of course, be used and will be readily apparent to those building a switch assembly to a particular specification.

Although the structure with the support openings larger than the spring is preferred for facilitating construction to different specification, for field assembly and the like, a fixed factory assembly may be fabricated within the teaching of the present invention. The mounting of the actuator 10 and the spring structure are thus shown in a preferred embodiment. Various other variations in such actuator and spring structure may, of course, be provided within the broad concept of the present invention. Thus, the spring structure may take other beam-like supporting arrangements and may include, for example, a spring fixedly secured to an actuator and interconnected by end extension of the spring to a support structure. The end extension may be specially configured to allow the linear or in line movement of actuator relative to the switch structure.

The telescoped walls 9 and 29 of units 4 and 6 are preferably releasably interconnected to firmly fix the switch support to the supporting walls 9 of the pressure responsive unit.

Referring to FIGS. 3–6, each flat guide wall 9 of the pressure responsive unit includes a similar latch opening 40. The flat portions 30 of side walls 29 of the switch support 26 include cam members 41 adapted to move between the walls 9. Each cam member 41 has tapered wall 42 which engage the abutting wall 9 and create an outward deflecting force. Walls 9 are sufficiently flexible to allow the members 41 to move into and between the walls 9 into alignment with the openings 40, which then allow walls 9 to snap outwardly. The cam walls 41 have a locking edge 43 located outwardly through opening 40 and thereby firmly secure the switch support to the pressure responsive unit 9. The limited flexibility of the wall structures permit the similar disassembly of the switch support from the pressure responsive unit.

The outer circular wall 27 is truncated as shown in FIG. 2 with flat ends aligned with the coupling wall portions 30 to form the pass-thru opening for switch housing 45. The opposite sidewall portion of wall 27 are further recessed as at 48 to define inner flexible walls 49. Clamp projections 50 are formed on the inner face of walls 49 and mate with recesses in the abutting walls of housing 45.

The outer portions of circular walls 27 extend outwardly to engage an end of the plastic band 3 for locating the upper edge thereof. The base 5 of the pressure unit 4 is similarly constructed to locate the lower edge of the band 36. The band 36 is preferably such as to effectively seal the chamber 32 from the surrounding environment.

With the openings 34 extended completely through the support walls 9, some structure must be provided to prevent longitudinal movement of the spring 8 from the structure. In the illustrated embodiment of the invention, the elastic band member 36 is shown encircling the unit, and is of sufficient flexibility to allow ready and simple attachment and removal while firmly and reliably securing of the flat springs in location. Other methods can be used such as providing an insert within the support openings 34, forming the spring ends to fit firmly within the openings, application of mechanical securement elements in the openings or to the exterior of walls 9 or the like.

Although the present switch structure can be applied to various sized pressure switches, it is uniquely adapted to subminiature size requirements such as demanded with the development of miniaturization of control circuitry and the like. For example, the switch assembly has been constructed for a typical and practical application having a size specification for the switch assembly of approximately three-eighths inch in diameter and five-sixteenths of an inch in length, and operable in various ranges within a total range of 0 to 100 pounds per square inch, preferably as high as 100 PSI. The present invention provides a switch structure which can be constructed in various embodiments and is illustrated in a particular embodiment having a plurality of readily formed components using present day technology and permitting not only cost effective factory fabrication and assembly but subsequent in-field assembly and disassembly. The switch structure may therefore be constructed for various specifications as well as convenient maintenance of the switch apparatus.

Various modes of carrying out the invention are contemplated as being within the scope of the following claims particularly pointing out and distinctly claiming the subject matter which is regarded as the invention.

I claim:

1. A pressure responsive switch apparatus, comprising a base support structure having an inlet port and having a diaphragm secured in overlying relation to said port, said diaphragm moving in a path in response to the pressure level at said port, a spring carrier movably mounted within said support structure and confined to a substantially linear path extending from said diaphragm and the path of said diaphragm, said carrier having a carrier opening extended therethrough, a beam spring member extended through said carrier opening and coupled to said support structure and supporting said carrier for movement in said linear path, and a switch unit secured to said base support structure with an operator in the path of said carrier and actuated thereby in response to movement of said carrier in accordance with pressure in said port.

2. The pressure responsive switch apparatus of claim 1 wherein said base support structure includes first and second members located on both sides of said carrier and including aligned openings in both members aligned with the carrier opening, said spring being a flat beam spring extended through the carrier opening and the openings in said first and second members, and a closure unit releasably secured to the first and second members to support and confine said spring within said openings.

3. The switch apparatus of claim 2 wherein said carrier opening includes a curved wall and an opposed wall, said opening being oriented with the curved wall located to move into engagement with said spring in response to increasing pressure in said port.

4. The switch apparatus of claim 2 wherein said base support structure includes first and second walls spaced on both sides of said carrier for confining movement of said carrier therebetween in said linear path, a switch support having an inner wall coupled to said first and second walls and having a switch chamber in outwardly spaced relation to said carrier, said switch chamber adapted to receive and releasably support a switch with a switch operator located in the path of said carrier.

5. The apparatus of claim 4 wherein said inner wall of said switch support projects inwardly into clamping engagement with said diaphragm to secure said diaphragm in sealed relation to said base support structure.

6. The apparatus of claim 1 wherein said base support structure includes a pressure plate having first and second flexible side walls projecting outwardly from said plate, said plate having a circular groove immediately inwardly of said side walls, said diaphragm unit having an outer convolution and a depending lip terminating in an enlargement complementing and fitted within said circular groove, and said switch unit including a clamping wall projecting about said carrier into clamping engagement with said enlargement.

7. The apparatus of claim 6 wherein said switch unit includes a switch support having flat side walls telescoped into said flexible side walls and terminating in clamping engagement with said annular enlargement, a releasable coupling interconnecting said flat sidewalls to said flexible side walls, said spring carrier disposed in sliding abutting engagement with said flat side walls, said carrier opening facing said flat side walls, said flat side walls and said flexible side walls having said aligned openings aligned with the opening in said carrier, said spring passing through said side wall openings and said carrier opening and providing a resilient support of said carrier for engagement with said diaphragm, the pressure response range of said switch apparatus being controlled by the spring characteristic of said spring, and releasable confining structure secured to said side walls for securing of said spring within said openings and thereby permitting selective insertion of a spring with a desired characteristic within said openings to set the pressure responsive range of said switch apparatus.

8. The switch apparatus of claim 7 wherein said confining structure include an elastic band wrapped about the support structure in alignment with said openings.

9. A pressure responsive apparatus comprising a pressure sensor including an inlet unit and a pressure chamber having an outer movable wall, a guide wall structure extending outwardly of said pressure chamber and said movable wall, a switch actuator movably located within said guide wall structure and having a spring opening extended through the actuator, said guide wall structure having support openings aligned with the opposite ends of said spring opening, a beam spring located within the aligned openings of said guide wall structure and said actuator and supporting said actuator adjacent said movable wall and establishing a spring loaded return action on said actuator opposing the force of said diaphragm, said spring characteristic determining the pressure responsive range of said pressure responsive apparatus.

10. The pressure responsive apparatus of claim 9 including a snap action switch unit connected to said guide wall structure with a switch actuator located in a path of said actuator.

11. The pressure responsive apparatus of claim 9 including a releasable enclosure secured to said guide wall structure to close said support openings for releasably supporting said beam spring in said openings, whereby said response characteristic is controllable by inserting of a selected spring in said actuator.

12. The pressure response apparatus of claim 11 including a plurality of said springs, each said spring having generally rectangular ends corresponding to said openings and a connecting portion of a selected width to establish a spring characteristic differing from that of other springs.

13. A pressure responsive switch apparatus, comprising a pressure responsive sensor adapted for connection to a pressure source and including a movable wall member moving in response to the level of pressure of the source, said sensor including a switch unit located in spaced relation to said movable wall member and forming a first chamber therebetween, a spring-loaded actuator movably mounted within said first chamber in the path of said movable wall member, said actuator including a carrier having an opening extended therethrough, a beam spring member extending through said opening and coupled to said pressure responsive sensor and a spring support structure secured to the opposite ends of said beam spring at the ends and thereby supporting said actuator for movement in a substantially linear path aligned with the path of said movable wall member for movement of the actuator into engagement with said switch unit.

14. The switch apparatus of claim 13 wherein said actuator opening includes a curved wall and an opposed flat wall, said opening being oriented with the curved wall located to move into engagement with said spring in response to increasing pressure in said sensor.

15. The pressure responsive switch apparatus of claim 13 wherein said sensor includes a body member having a pressure chamber including said movable wall member in the form of a diaphragm, said body member having first and second walls on the opposite sides of said pressure chamber and extending outwardly therefrom and forming a part of said support structure and sidewalls of said first chamber, said switch unit including a switch support having spaced walls abutting said first and second walls, said first and second walls and said spaced walls including aligned openings, said aligned openings being aligned with the openings in said carrier, said spring being a flat beam spring extended through the carrier opening and the openings in said first and second walls and said spaced walls of said switch support, and closure means releasably secured to the walls to support said spring contained within said openings.

16. The apparatus of claim 15 wherein said switch unit includes side walls projecting inwardly into clamping engagement with said diaphragm to secure said diaphragm in sealed relation to said body member.

17. A subminiature switch apparatus constructed for operation within different pressure ranges and having a maximum lateral dimension and a maximum height dimension of one inch, comprising a pressure responsive unit having an outer movable wall and outwardly projecting supporting walls extending outwardly of said movable wall, a switch unit having a switch support unit including a switch support section and mounting walls projecting outwardly from said switch support section, said mounting walls and said support walls having complementing surfaces for telescopic interconnection of the said mounting walls and said support walls and locating of said switch support section aligned and in spaced relation to said movable wall to define a switch operating chamber, a connector unit releasably interconnecting of said walls to each other, an actuator mounted in said switch operator chamber for movement between said movable wall and said switch support section for actuating of a switch in said support section, said switch actuator including a block member and a mounting spring releasably secured to said member and to at least one of said supporting walls, said spring defining the pressure responsive range of said switch apparatus, said spring supporting said actuator for engagement with said diaphragm in response to a minimum pressure in said pressure range and movable therefrom with increasing pressure and operable to engage said switch operator at a second switch level and thereby operating said switch at any pressure within said minimum and maximum pressure, said wall structure being constructed and arranged for ready access to said actuator and said spring for releasable mounting of said switch actuator and for selective attachment of the spring to said actuator and thereby setting the pressure responsive range of said switch apparatus.

* * * * *

UNITED STATES PATENT AND TRADEMARK OFFICE
CERTIFICATE OF CORRECTION

PATENT NO. : 5,661,278

DATED : August 26, 1997

INVENTOR(S) : LOUIS D. ATKINSON ET AL.

It is certified that error appears in the above-identified patent and that said Letters Patent is hereby corrected as shown below:

On the face, in the Title delete "COUPLES" and insert ---COUPLED---; Column 1, line 2 delete "COUPLES" and insert ---COUPLED---

Signed and Sealed this

Third Day of February, 1998

*Attest:*

*Attesting Officer*

Bruce Lehman

BRUCE LEHMAN

*Commissioner of Patents and Trademarks*